US005730629A

United States Patent [19]

Samejima et al.

[11] Patent Number: 5,730,629

[45] Date of Patent: Mar. 24, 1998

[54] TERMINAL PARTS AND METHOD OF MANUFACTURING SAME

[75] Inventors: Masakuni Samejima; Isao Kameyama; Hideto Kumakura, all of Shizuoka-ken, Japan

[73] Assignee: Yazaki Corporation, Tokyo, Japan

[21] Appl. No.: 713,457

[22] Filed: Sep. 13, 1996

[30] Foreign Application Priority Data

Sep. 14, 1995 [JP] Japan ..... 7-237129

[51] Int. Cl.[6] ..... H01R 11/22

[52] U.S. Cl. ..... 439/855; 439/857; 29/874

[58] Field of Search ..... 439/842, 843, 439/845, 849–857; 29/874, 882, 884

[56] References Cited

U.S. PATENT DOCUMENTS

| | | | |
|---|---|---|---|
| 3,760,340 | 9/1973 | Friend . | |
| 5,611,715 | 3/1997 | Samejima | 439/851 |
| 5,666,723 | 9/1997 | Ohtaka et al. | 29/874 |

FOREIGN PATENT DOCUMENTS

| | | |
|---|---|---|
| 51-51490 | 4/1976 | Japan . |
| 52-22593 | 2/1977 | Japan . |
| 59-79982 | 5/1984 | Japan . |
| 4-315778 | 11/1992 | Japan . |
| 7-320807 | 12/1995 | Japan . |
| 2 220 310 | 1/1990 | United Kingdom . |

*Primary Examiner*—Hien Vu
*Assistant Examiner*—Brian J. Biggi
*Attorney, Agent, or Firm*—Finnegan, Henderson, Farabow, Garrett & Dunner, L.L.P.

[57] ABSTRACT

The disclosed terminal part can protect the elastic contact portion securely, without increasing the manufacturing cost thereof. The terminal part (43) is formed with a wire connecting portion (3); an elastic contact portion (5); and a top plate portion (49) formed between the wire connecting portion (3) and the elastic contact portion (5). The top plate portion (49) has a lower top plate portion (45) and an upper top plate portion (47). In particular, a lower engage projection (55) formed at the end of the lower top plate portion (45) is engaged with an upper engage hole (57) formed in the upper top plate portion (47), and further an upper engage hook (41) formed at the end of the upper top plate portion (47) is engaged with a lower engage hole (39) formed in the lower top plate portion (45). Therefore, it is possible to securely protect the two side plate portions (13, 15) from being deformed inward even if an external force (F3) is applied to the terminal part inadvertently.

6 Claims, 4 Drawing Sheets

TERMINAL PARTS AND METHOD OF MANUFACTURING SAME

BACKGROUND OF THE INVENTION

1. Field of the Invention

The present invention relates to a terminal part and a method of manufacturing the same terminal part, and more specifically to the terminal part having a wire connecting portion connected to a wire end, an elastic contact portion connected to a mated terminal, and a top plate portion formed between the wire connect portion and the elastic contact portion.

2. Description of the Prior Art

In general, a terminal part is formed with a wire connecting portion for clamping a wire end and an elastic contact portion connected to a mated terminal. Further, the wire connecting portion is formed with an insulation clamping portion for clamping the insulating substance of a wire and a conductor clamping portion for clamping the wire conductor. Further, the elastic contact portion is formed with a bottom plate portion, two opposing side plate portions bent from both sides of the bottom plate portions, and two opposing reverse U-shaped contact portions bent from the side plate portions, respectively to hold the mated male terminal between the two. Further, two supporting wall portions having a slit therebetween is formed between the wire connecting portion and the elastic contact portion, to support the end of the mated terminal.

In the terminal part constructed as described above, when a mated terminal (a male plate-shaped terminal, in this example) is inserted into the slit of the two supporting wall portions and between the two opposing contact portions, since the mated terminal can be elastically supported by the two opposing contact portions, the mated terminal can be connected to the terminal part electrically.

In the above-mentioned metal parts, however, since the elastic contact portion is exposed, the elastic contract portion may be easily deformed or damaged during handling or in transport, so that it is impossible to securely connect the mated terminal with the terminal parts. To overcome this problem, the elastic contact portion is usually enclosed by a protective member to prevent the elastic contact portion from being deformed or damaged by an external force applied inadvertently, as disclosed in U.S. Pat. No. 3,780,340 or Japanese Published Unexamined (Kokal) Patent No. 4-315778.

In the above-mentioned prior art terminal parts, however, since an additional protective member is formed around the elastic contact portion, an additional die for molding the protective member is required. Further, since an additional step of attaching the protective member to the terminal parts is necessary, there exists a problem in that the manufacturing cost of the terminal parts increases.

To overcome this problem, a method of punching out both the terminal parts and the protective member at the same time has been proposed, as disclosed in Japanese Published Unexamined (Kokai) Utility Model Nos. 51-51490 and 52-22593 and British Patent No GB-2220310. In this method, when the terminal parts is formed, four wall portions of the protective member are bent so as to surround the elastic contact portion. In this case, since the elastic contact portion can be enclosed by the protective member, it is possible to prevent the elastic contact portion from being deformed and damaged.

In this method, however, when an external force is applied to each wall portion of the protective member and thereby each wall portion is dislocated from each other, since the entire shape of the terminal parts is deformed, there arises another problem in that the terminal parts cannot be inserted into a terminal accommodating chamber smoothly or cannot be engaged with the terminal accommodating chamber securely.

To overcome this problem, the same Applicant has already proposed a terminal parts which can protect the elastic contact portion without use of an additional protective member, by Japanese Patent Application No. 7-73852. In this proposed method, a box portion is additionally formed on the rear side of the elastic contact portion to increase the rigidity of the elastic contact portion. In more detail, two opposing rear protective plate portions are formed extending from two side plate portions in such a way that two end surfaces thereof are brought into contact with each other in order to receive an external force applied in the lateral (e.g., horizontal) direction of the terminal parts. Further, an upper top plate portion and a lower top plate portion are formed also extending from the two side plate portions, respectively in such a way that the two upper and lower top plate portions can be engaged with each other in order to receive an external force applied in the lateral (e.g., vertical) direction of the terminal parts.

In the above-mentioned already proposed terminal parts, in order to obtain a strong rigidity against an external force applied in the lateral (both horizontal and vertical) direction, it is essential that the two opposing narrow end surfaces of the two protective plate portions must be securely brought into contact with each other. In other words, the respective protective side plate portions must be bent at a high precision in such a way that the end surfaces of the respective protective side plate portions of the box portion of the terminal parts can be brought into contact with each other. Accordingly, since a high precision is required for both the bending die and the bending process, there exists a problem in that the manufacturing cost thereof inevitably rises. In addition, since an additional box portion must be formed, the bending step is rather complicated. In addition, since the box portion is located between the wire connecting portion and the elastic contact portion, the box portion is obstructive when the wire is clamped to the wire connecting portion.

SUMMARY OF THE INVENTION

With these problems in mind, therefore it is the object of the present invention to provide a terminal parts and a method of manufacturing the terminal parts, which can securely protect the elastic contact portion thereof from external forces applied to the terminal parts inadvertently, without increasing the manufacturing cost thereof.

To achieve the above-mentioned object, the present invention provides a terminal parts formed with: a wire connecting portion (3) for connecting a wire end; an elastic contact portion (5) having; a bottom plate portion (11); two opposing side plate portions (13, 15) bent from both sides of the bottom plate portion; and two opposing reverse U-shaped contact end portions (13*a*, 15*a*) bent from the two side plate portions, respectively; a top plate portion (49) formed between the wire connecting portion (3) and the elastic contact portion (5), having: a lower top plate portion (45) bent from one (13) of the two side plate portions to the other (15) of the two side portions; and an upper top plate portion (47) bent from the other (15) of the two side plate portions to one (13) of the two side portions so as to be overlapped with the lower top plate portion (45); lower engaging means (51) for engaging an end of the lower top plate portion (45) with the upper top plate portion (47); and upper engaging means (53) for engaging an end of the upper top plate portion (47) with the lower top plate portion (45).

Further, said lower engaging means (51) comprises: a lower engage projection (55) formed at the end of the lower top plate portion (45); and an upper engage hole (57) formed in the upper top plate portion (47) and engaged with the lower engage projection; and said upper engaging means (53) comprises: an upper engage hook (41) formed at the end of the upper top plate portion (47); and a lower engage hole (39) formed in the lower top plate portion (45) and engaged with the upper engage hook.

Further, both side end surfaces (55*a*) of the lower engage projection (55) are in contact with an inner wall (57*a*) of the upper top plate portion (47) in the vicinity of the upper engage hole (57); and an inner surface of the upper engage hook (41) is in contact with an end surface (39*a*) of the lower engage hole (39) of the lower top plate portion (45).

Further, it is preferable that the terminal parts further comprises: an inner front protective plate portion (59) having a middle slit (65) and bent from the bottom plate portion at a front end of the terminal parts; and two opposing outer front protective plate portions (63, 65) bent from the two opposing side plate portions (13, 15), respectively with a gap (67) between the two, so as to cover the inner front protective plate portion (59).

Further, the present invention provides a method of manufacturing a terminal parts, comprising the steps of: pouching out at least one terminal parts including a wire connecting portion (3); an elastic contact portion (5) having a bottom plate portion (11), two opposing side plate portions (13, 15), and two opposing reverse U-shaped contact portions (13*a*, 15*a*); a top plate portion (49) having an upper top plate portion (47) and a lower top plate portion (45); and a front protective portion having an inner front protective plate portion (59) and two opposing outer front protective plate portions (61, 63) all in a developing state; bending the elastic contact portion (5) to form the two opposing reverse U-shaped contact portions (13*a*, 15*a*); bending the wire connecting portion (3); bending the inner front protective plate portion (59) from the bottom plate portion (11) and further the two outer front protective plate portions (61, 63) from the two side plate portions (13, 15), respectively; bending the reverse U-shaped contact portion (13*a*) and the lower top plate portion (45) from the side plate portion (13) and the reverse U-shaped contact portion (15*a*) and the upper top plate portion (47) from the side plate portion (15), respectively; bending the two opposing side plate portions (13, 15) from the bottom plate portion (11), respectively; bending the lower top plate portion (45) toward the upper top plate portion (47) so that an engage projection (55) of the lower top plate portion (45) can be engaged with an engage hole (57) of the upper top plate portion (47); and bending the upper top plate portion (47) toward the lower top plate portion (45) so that an upper engage hook (41) of the upper top plate portion (47) can be engaged with a lower engage hole (39) formed in the lower top plate portion (45).

Further, it is preferable that a plurality of terminal parts connected to one another by use of a band portion (69) are punched out and bent at the same time.

In summary, in the terminal parts according to the present invention, since the lower engaging means (51) for engaging the lower top plate portion (45) with the upper top plate portion (47) and further the upper engaging means (53) for engaging the upper top plate portion (47) with the lower top plate portion (45) are both formed, it is possible to increase the rigidity of the elastic contact portion (5) of the terminal parts against external forces applied in both the horizontal and vertical directions, so that the elastic contact portion (5) can be protected securely from the external forces.

DETAILED DESCRIPTION OF THE PREFERRED EMBODIMENTS

Figure 1:
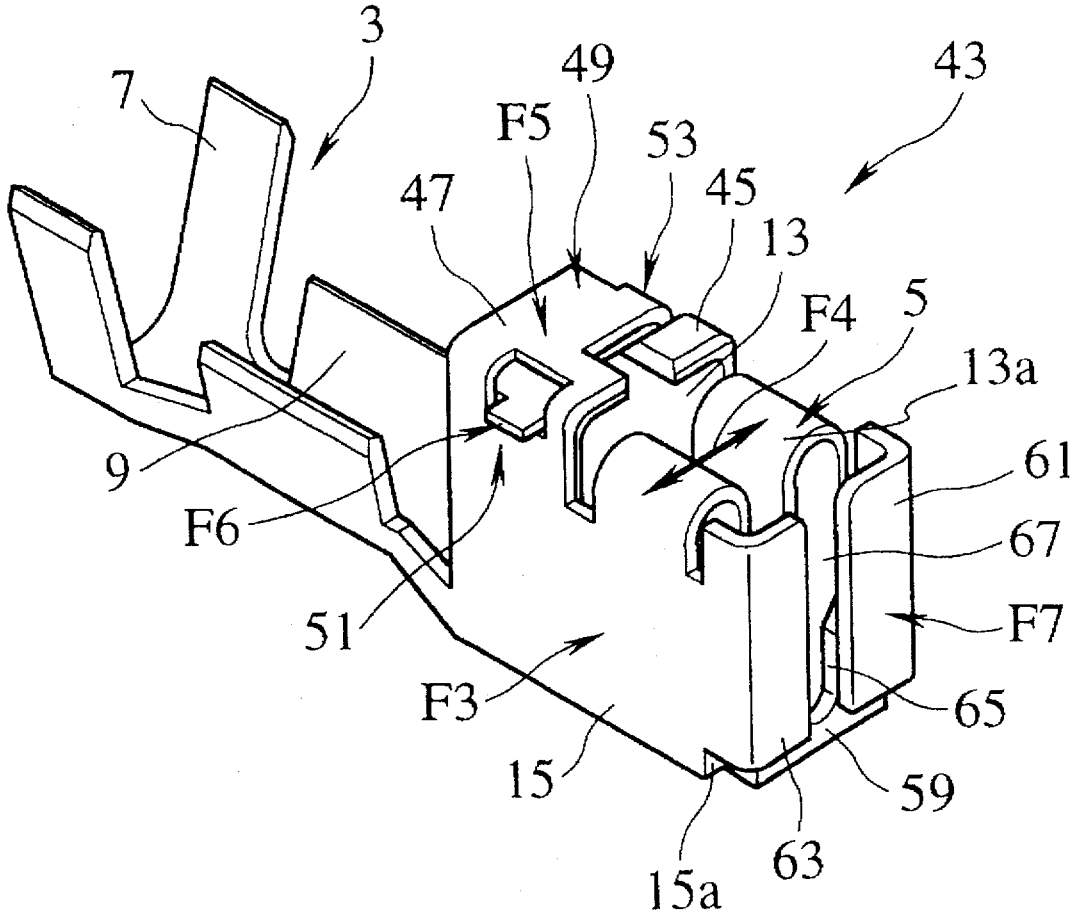
FIG. 1 is a perspective view showing an embodiment of the terminal parts according to the present invention.

An embodiment of the terminal part according to the present invention will be described hereinbelow with reference to the attached drawings.

The feature of the terminal part according to the present invention comprises a top plate portion 49 formed between a wire connecting portion 3 and an elastic contact portion 5 and provided with lower engaging means 51 and upper engaging means 53 so that the elastic contact portion 5 can be protected from external forces applied in both the horizontal and vertical directions.

In FIGS. 1 to 6, a terminal part 43 of the present invention is formed with a wire connecting portion 3 connected to a wire end, an elastic contact portion 5 mated with a plate-shaped male terminal, and a top plate portion 49 for protecting the elastic contact portion 5.

The wire connecting portion 3 is composed of a wire insulating substance clamping portion 7 and a wire conductor clamping portion 9. The elastic contact portion 5 is composed of a bottom plate portion 11, and two opposing side plate portions 13 and 15 bent from both sides of the bottom plate portion 11, and two opposing reverse U-shaped contact portions **13*a* and 15*a* bent from the two side plate portions 13 and 15, respectively. The mated terminal (not shown) is inserted into between the two opposing U-shaped contact portions 13*a* and 15*a*** for electric contact.

Further, the top plate portion 49 formed between the wire connecting portion 3 and the elastic contact portion 5 is composed of a lower top plate portion 45 bent inwardly at roughly a right angle from the side plate portion 13 and an upper top plate portion 47 also bent inwardly at roughly a right angle from the side plate portion 15. Here, the upper top plate portion 47 is bent inward so as to be overlapped with the lower top plate portion 45 as depicted in FIGS. 2 and 3.

In addition to the above-mentioned construction, the terminal parts is formed with an inner front protective plate portion 59 and two opposing outer front protective plate portions 61 and 63. The inner front protective plate portion 59 is bent at roughly a right angle from the bottom plate portion 11 between the two opposing side plate portions 13 and 15 in a direction perpendicular to the two side plate portions 13 and 15. The outer front protective plate portions 61 and 63 are bent also at a roughly right angle from the two side plate portions 13 and 15, respectively so as to enclose the inner front protective plate portion 59 in parallel to the inner front protective plate portion 59.

Further, the terminal parts 43 according to the present invention is provided with lower top engaging means 51 for engaging an outward end portion of the lower top plate portion 45 with the upper top plate portion 47 and further upper top engaging means 53 for engaging an outward end portion of the upper top plate portion 47 with the lower top plate portion 45.

Figure 2:
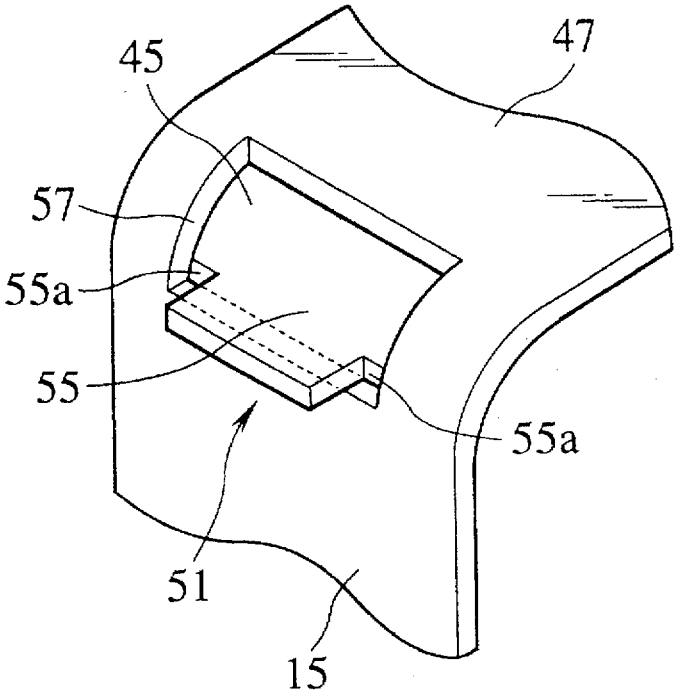
FIG. 2 is an enlarged perspective view showing only a lower engage portion of the embodiment shown in FIG. 1.
Figure 3:
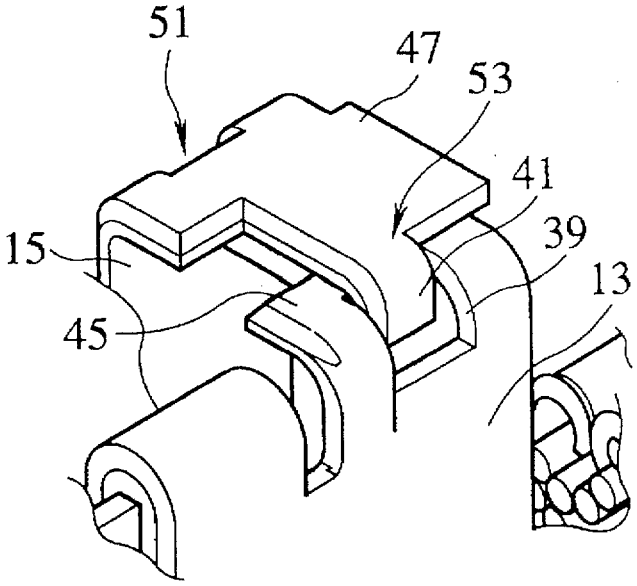
FIG. 3 is an enlarged perspective view showing only an upper engage portion of the embodiment shown in FIG. 1.

In more detail, as depicted in FIG. 2, the lower top engaging means 51 is composed of a lower engage projection 55 formed at the end surface of the lower top plate portion 45 and a rectangular upper engage hole 57 formed in the junction portion between the side plate portion 15 and the upper top plate portion 47. Here, the lower top plate portion 45 extending from the side plate portion 13 is bent at a right angle toward the opposing side plate portion 15. Therefore, when the lower engage projection 55 is engaged with the upper engage hole 57, it is possible to engage the lower top plate portion 45 with the upper top plate portion 47 in such a way that both side end surfaces 55*a* (shown in FIG. 2) of the lower engage projection 55 are in contact with the inner wall 57*a* (shown in FIG. 6) of the upper top plate portion 47 in the vicinity of the upper engage hole 57.

Further, as depicted in FIG. 3, the upper top engaging means 53 is composed of an upper engage hook 41 formed at the end of the upper top plate portion 47 and a rectangular lower engage hole 39 formed in the junction portion between the side plate portion 13 and the lower top plate portion 45. Here, after the lower engage projection 55 has been inserted into and engaged with the upper plate engage hole 57 as shown in FIG. 2, the upper top plate portion 47 extending from the side plat portion 15 is bent at roughly a right angle toward the opposing side plate portion 13. Therefore, when the upper engage hook 41 is engaged with the lower engage hole 39 formed in the lower top plate portion 45, it is possible to engage the end of the upper top plate portion 47 with the lower top plate portion 45 in such a way that the inner surface of the upper engage hook 41 is in contact with the end surface 39*a* (shown in FIG. 6) of the lower engage hole 39 formed in the lower top plate portion 45.

The shape of the terminal parts 43 will be explained in further detail with reference to FIG. 4, in which dashed lines indicate positions to be bent.

The inner front protective plate portion 59 is formed extending from the front of the bottom plate portion 11. The length of the inner front protective portion 59 is roughly a half of the height of the elastic contact portion 5. Further, the inner front protective plate portion 59 is formed with an middle slit 85 at such a position that a mated male terminal (not shown) is inserted. The inner front protective plate portion 59 is bent at roughly a right angle from the bottom plate portion 11 so as to be located perpendicular to the two side plate portions 13 and 15. Therefore, when an external force F3 (as shown in FIG. 1) is applied inadvertently, the inner wall portions of the two opposing side plate portions 13 and 15 are brought into contact with the inner front protective plate portion 59 to receive the applied external force F3.

Further, on the front side of the inner front protective plate portion 59, the two opposing outer front protective plate portions 61 and 63 are formed. These outer front protective plate portions 61 and 63 extend from the front end sides of the two side plate portions 13 and 15, respectively, and further bent at roughly a right angle so as to be opposed to each other at the front side of the terminal parts. In this case, the inner front protective plate portion 59 is located between the elastic contact portion 5 and the two outer front protective plate portions 61 and 63. Further, a gap 67 (shown in FIG. 1) is formed between the two opposing outer front protective plate portions 61 and 63 in correspondence to the slit 65 formed in the inner front protective plate portion 59. These outer front protective plate portions 61 and 63 receive an external force F7 (as shown in FIG. 1) applied from the front side of the terminal parts 43.

On the other hand, the top plate portion 49 is composed of the lower top plate portion 45 extending from the side plate portion 13 and further bent to the opposing side plate portion 15, the upper top plate portion 47 extending from the side plate portion 15 and further bent to the opposing side plate portion 13. Here, the upper top plate portion 47 is overlapped with the lower top plate portion 45. Therefore, when an external force F6 (as shown in FIG. 1) is applied to the terminal parts 43, since the both side surfaces 55*a* of the lower plate engage projection 55 of the lower top plate portion 45 are brought into contact with the inner wall 57*a* of the upper engage hole 57, it is possible to prevent the side plate portion 15 from being bent inward. Further, when an external force F4 (as shown in FIG. 1) is applied in the direction that the two contact portions 13*a* and 15*a* are separated away from each other, since the upper engage hook 41 of the upper top plate portion 47 is engaged with inner end surface 39*a* of the lower engage hole 39 formed in the lower top plate portion 45, it is possible to prevent the two side plate portions 13 and 15 from being widened by the external force F4.

The method of manufacturing the terminal parts 43 according to the present invention will be described hereinbelow. FIG. 4 is a development view showing the terminal parts 43 as shown in FIG. 1. First, the terminal parts 43 as shown in FIG. 4 is punched out from a flat and long plate. In this punching process, a plurality of terminal parts 43 connected to one another in the lateral direction thereof by use of a band portion 69 are punched out and bent at the same time.

Figure 4:
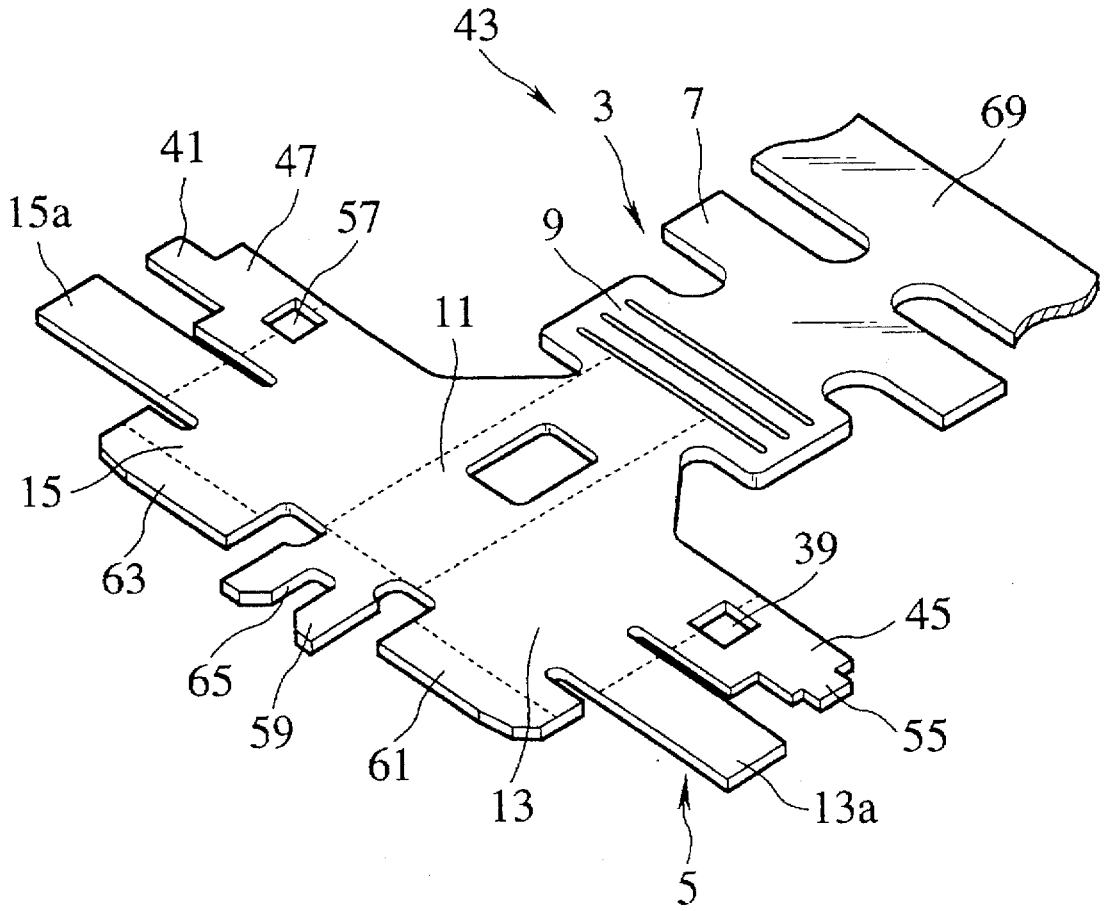
FIG. 4 is a development view of the embodiment shown in FIG. 1.
Figure 5:
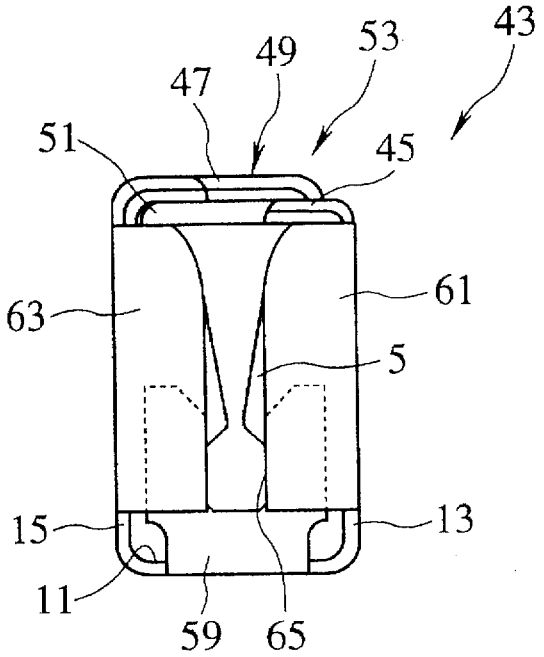
FIG. 5 is a side view showing the embodiment shown in FIG. 1.
Figure 6:
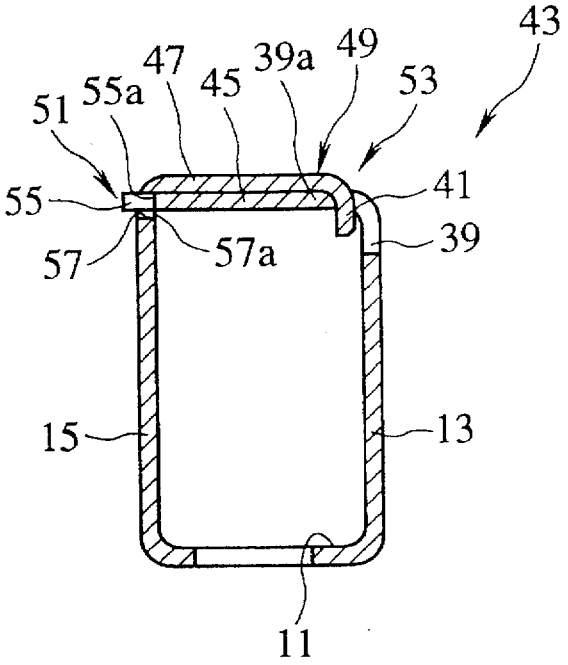
FIG. 6 is a cross-sectional view showing the embodiment shown in FIG. 1.

Therefore, whenever the terminal parts 43 as shown in FIG. 4 in the development state is punched out, the wire connecting portion 3, the elastic contact portion 5, the bottom plate portion 11, the side plat portions 13 and 15, the inner front protective plate portion 59, the two opposing outer front protective plate portions 61 and 63, the upper top plate portion 47, the lower top plate portion 45, the upper engage hole 57, the lower engage projection 55, the lower engage hole 39, and the upper engage hook 41 are all formed.

After that, the elastic contact portion 5 is bent to form the two opposing reverse U-shape contact portions 13*a* and 15*a*, and further the wire connecting portion 3 is bent into a wide U-shape.

Further, the inner front protective plate portion 59 is bend at roughly a right angle from the bottom plate portion 11, and further the two outer front protective plate portions 61 and 63 are bent also at roughly a right angle from the two side plate portions 13 and 15, respectively.

Further, the reverse U-shaped contact portion 13*a* and the lower plate portion 45 are bent from the side plate portion 13 at roughly a right angle, and further the reverse U-shaped contact portion 15*a* and the upper plate portion 47 are bent from the side plate portion 15 at roughly a right angle.

Further, the two opposing side plate portions 13 and 15 are bend from the bottom plate portion 11 at roughly a right angle.

Further, the lower plate portion 45 is bent toward the upper top plate portion 47 in such a way that the engage projection 55 of the lower top plate portion 45 can be engaged with the engage hole 57 of the upper top plate portion 47.

Further, the upper top plate portion 47 is bent toward the lower top plate portion 45 in such a way that the upper engage hook 41 of the upper top plate portion 47 can be engaged with the engage hole 39 of the lower top plate portion 45. The terminal parts 43 can be completed as described above.

In the terminal parts according to the present invention, when the external force F6 (as shown in FIG. 1) for deforming the side plate portions 13 and 15 inward is applied, since the both end surfaces of the inner front protective plate portion 59 are brought into contact with the inner wall of the two side plate portions 13 and 15, it is possible to increase the rigidity in this lateral direction, with the result that the two side plate portions 13 and 15 can be prevented from being bent inward by the external force F6 applied inadvertently.

Further, when the external force F4 (as shown in FIG. 1) for deforming the elastic contact portion 5 in the direction that the two contact end portions 13*a* and 15*a* are widened, since the upper engage hook 41 is engaged with the engage hole 39, it is possible to prevent the two contact portions 13*a* and 15*a* from being widened.

In addition, when the external force F5 (as shown in FIG. 1) is applied to the terminal parts 43 in the vertical direction, since the top plate portion 49 is formed and further since the lower engage projection 55 of the lower top plate portion 45 is engaged with the upper plate engage hole 57, it is possible to prevent the entire terminal parts 43 from being deformed, so that the elastic contact portion 5 is not deformed.

Further, when the external force F6 (as shown in FIG. 1) for compressing the two side plate portions 13 and 15 is applied, since the lower engage projection 55 is engaged with the upper plate engage hole 57 formed in the upper top plate portion 47, it is possible to increase the rigidity in this direction, with the result that the two side plate portions 13 and 15 are not deformed by the external force F6 applied inadvertently.

Further, when an external force F7 (as shown in FIG. 1) is applied from the front side of the terminal parts 43, since the two outer front protective plate portions 61 and 63 receive this force F7 and further since this external force F7 is not directly applied to the elastic contact portion 5, it is possible to prevent the elastic contact portions 5 from being deformed.

Further, in the terminal parts 43, since the lower engage projection 55 is engaged with the upper engage hole 57, even when the upper top plate portion 47 is bent toward the lower top plate portion 45 to engage the upper engage hook 41 with the lower engage hole 39, it is possible to prevent the lower top plate portion 45 from being bent inward. Therefore, it is possible to reduce the number of defective terminal parts, so that the production yield of the terminal parts can be improved.

Further, in the manufacturing method according to the present invention, since the upper top plate portion 47 and the lower plate portion 45 are not directly brought into contact with each other, it is unnecessary to bent both the upper top plate portion 47 and the lower top plate portion 45 at high precision, so that the terminal parts can be manufactured easily and thereby the manufacturing cost thereof is reduced.

Further, in the terminal parts according to the present invention, since a rear protective plate portion is not formed on the side of the wire connecting portion 3 (being different from the prior art terminal parts), the length of the terminal parts 43 can be reduced and the bending process of the rear protective plate portion can be eliminated, so that the manufacturing cost thereof can be reduced. In addition, since the wire can be clamped to the wire connecting portion 3 without being obstructed by the rear protective plate portion, the wire clamping work can be facilitated.

In summary, in the terminal parts according to the present invention, since the lower engaging means (51) for engaging the lower top plate portion (45) with the upper top plate portion (47) and further the upper engaging means (53) for engaging the upper top plate portion (47) with the lower top plate portion (45) are both formed, it is possible to increase the rigidity of the elastic contact portion (5) of the terminal parts against external forces applied in both the horizontal and vertical directions, so that the elastic contact portion (5) can be protected securely from the external forces.

What is claimed is:

1. A terminal part formed with:

a wire connecting portion (3) for connecting a wire end;

an elastic contact portion (5) having;

a bottom plate portion (11);

two opposing side plate portions (13, 15) bent from both sides of the bottom plate portion; and two opposing reverse U-shaped contact end portions (13*a*, 15*a*) bent from the two side plate portions, respectively;

a top plate portion (49) formed between the wire connecting portion (3) and the elastic contact portion (5), having:

a lower top plate portion (45) bent from one (13) of the two side plate portions to the other (15) of the two side portions; and an upper top plate portion (47) bent from the other (15) of the two side plate portions to one (13) of the two side portions so as to be overlapped with the lower top plate portion (45);

lower engaging means (51) at an end of the lower top plate portion (45) for engaging with the upper top plate portion (47); and upper engaging means (53) at an end of the upper top plate portion (47) for engaging with the lower top plate portion (45).

2. The terminal part of claim 1, wherein:

said lower engaging means (51) comprises:

a lower engage projection (55) formed at the end of the lower top plate portion (45); and an upper engage hole (57) formed in the upper top plate portion (47) and engaged with the lower engage projection; and said upper engaging means (53) comprises:

an upper engage hook (41) formed at the end of the upper top plate portion (47); and a lower engage hole (39) formed in the lower top plate portion (45) and engaged with the upper engage hook.

3. The terminal part of claim 2, wherein:

both side end surfaces (55*a*) of the lower engage projection (55) are in contact with an inner wall (57*a*) of the upper top plate portion (47) in the vicinity of the upper engage hole (57); and an inner surface of the upper engage hook (41) is in contact with an end surface (39*a*) of the lower engage hole (39) of the lower top plate portion (45).

4. The terminal part of claim 1, which further comprises:

an inner front protective plate portion (59) having a middle slit (65) and bent from the bottom plate portion at a front end of the terminal part; and two opposing outer front protective plate portions (63, 65) bent from the two opposing side plate portions (13, 15), respectively with a gap (67) between the two, so as to cover the inner front protective plate portion (59).

5. A method of manufacturing a terminal part, comprising the steps of:

pouching out at least one terminal part including a wire connecting portion (3); an elastic contact portion (5) having a bottom plate portion (11), two opposing side plate portions (13, 15), and two opposing reverse U-shaped contact portions (**13*a*, 15*a*); a top plate portion (49) having an upper top plate portion (47) and a lower top plate portion (45); and a front protective portion having an inner front protective plate portion (59) and two opposing outer front protective plate portions (61, 63**) all in a developing state;

bending the elastic contact portion (5) to form the two opposing reverse U-shaped contact portions (**13*a*, 15*a***);

bending the wire connecting portion (3);

bending the inner front protective plate portion (59) from the bottom plate portion (11) and further the two outer front protective plate portions (61, 63) from the two side plate portions (13, 15), respectively;

bending the reverse U-shaped contact portion (**13*a*) and the lower top plate portion (45) from the side plate portion (13) and the reverse U-shaped contact portion (15*a*) and the upper top plate portion (47) from the side plate portion (15**), respectively;

bending the two opposing side plate portions (13, 15) from the bottom plate portion (11), respectively;

bending the lower top plate portion (45) toward the upper top plate portion (47) so that an engage projection (55) of the lower top plate portion (45) can be engaged with an engage hole (57) of the upper top plate portion (47); and bending the upper top plate portion (47) toward the lower top plate portion (45) so that an upper engage hook (41) of the upper top plate portion (47) can be engaged with a lower engage hole (39) formed in the lower top plate portion (45).

6. The method of manufacturing a terminal part of claim 5, wherein a plurality of terminal parts connected to one another by use of a band portion (69) are punched out and bent at the same time.

* * * * *